US006640862B1

(12) United States Patent
Lee et al.

(10) Patent No.: US 6,640,862 B1
(45) Date of Patent: Nov. 4, 2003

(54) MULTI-FUNCTIONAL STICKER DEVICE FOR A COMPACT DISK

(76) Inventors: Jack Lee, 3F, 801, Chung-Cheng Rd., Chung Ho City, Taipei Hsien (TW); Zeno Lee, 3F, 801, Chung-Cheng Rd., Chung Ho City, Taipei Hsien (TW)

( * ) Notice: Subject to any disclaimer, the term of this patent is extended or adjusted under 35 U.S.C. 154(b) by 506 days.

(21) Appl. No.: 09/717,011

(22) Filed: Nov. 22, 2000

(51) Int. Cl.[7] ..... B65C 1/02; B65C 1/00; B65C 9/26

(52) U.S. Cl. ..... 156/391; 156/556; 156/580; 156/DIG. 1; 156/DIG. 2

(58) Field of Search ..... 369/275.5, 282, 369/289, 290, 291, 272, 273; 156/580, 581, 556, 538, 391, 579, DIG. 37, DIG. 1, DIG. 2

(56) References Cited

U.S. PATENT DOCUMENTS 5,951,819 A * 9/1999 Hummell et al. ..... 156/556
6,189,590 B1 * 2/2001 Tsay ..... 156/581
6,315,021 B1 * 11/2001 Lee et al. ..... 156/391
6,321,811 B1 * 11/2001 Atkinson et al. ..... 156/391
6,408,918 B1 * 6/2002 Hummell et al. ..... 156/391
6,508,914 B1 * 1/2003 Schwaller et al. ..... 156/391

* cited by examiner

*Primary Examiner*—Richard Crispino
*Assistant Examiner*—Sue A. Purvis

(57) ABSTRACT

A multi-functional sticker device for a compact disk is composed of a base and a lid. The lid at two opposite lateral sides thereof is formed a locating recess to engage with a guide plate respectively. A spring is provided between the base and the lid and a movable seat is disposed at the top of the spring with a central cylinder to extend upward through a central hole of a fixing disk on the lid. The fixing disk is provided with two opposite elongated slots with respect to the central hole and the central cylinder is provided with two engaging frames extending outward oppositely with slits corresponding to these two slots. The sticker is laid on the fixing disk to be attached to a circular compact disk being pressed to move downward.

5 Claims, 4 Drawing Sheets

MULTI-FUNCTIONAL STICKER DEVICE FOR A COMPACT DISK

BACKGROUND OF THE INVENTION

1. Field of the Invention

The present invention relates to a multi-functional sticker device for a compact disk. In particular, the present invention relates to a sticker device, which is possible for a sticker to be fixedly attached to a circular compact disk or a name card shaped compact disk.

2. Description of Related Art

It is known that the compact disk is widely used by consumers at the present time. In order to be known the content stored in a compact disk, an identification sticker is needed to fixedly attach to the compact disk so that the consumer can make a selection to cross out unnecessary compact disks before his desirable being loaded in a CD-ROM.

A conventional sticker device for a compact disk usually comprises a hollow base, a shaft fixed in the hollow base, a spring surrounding the shaft, a pressing pipe on top of the spring and enclosing the shaft. In addition, a lock ring and a pressing plate are provided to engage with each other above the base.

In practice, the sticker is put on the shaft and a press piece is placed on the shaft to push the compact disk downward such that the sticker can be attached to the compact disk fixedly. However, there is a disadvantage for the conventional device that it does not work for a name card shaped compact disk. Hence, it is worth to have an improvement on the conventional sticking device.

SUMMARY OF THE INVENTION

A multi-functional sticker device for a compact disk according to the present invention is composed of a base and a lid. The lid at two opposite lateral sides thereof is formed a locating recess to engage with a guide plate respectively. A spring is provided between the base and the lid and a movable seat is disposed at the top of the spring with a central cylinder to extend upward through a central hole of a fixing disk on the lid. The fixing disk is provided with two opposite elongated slots with respect to the central hole and the central cylinder is provided with two engaging frames extending outward oppositely. The respective engaging frame has slits corresponding to the respective elongate slot.

When a sticker is going to be stuck on a circular compact disk, the sticker is laid on the fixing disk.

A primary object of the present invention is to provide a multi-functional sticker device for a compact disk, which is not only for a circular compact disk but also for a name card shaped compact disk to be stuck a sticker simply.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
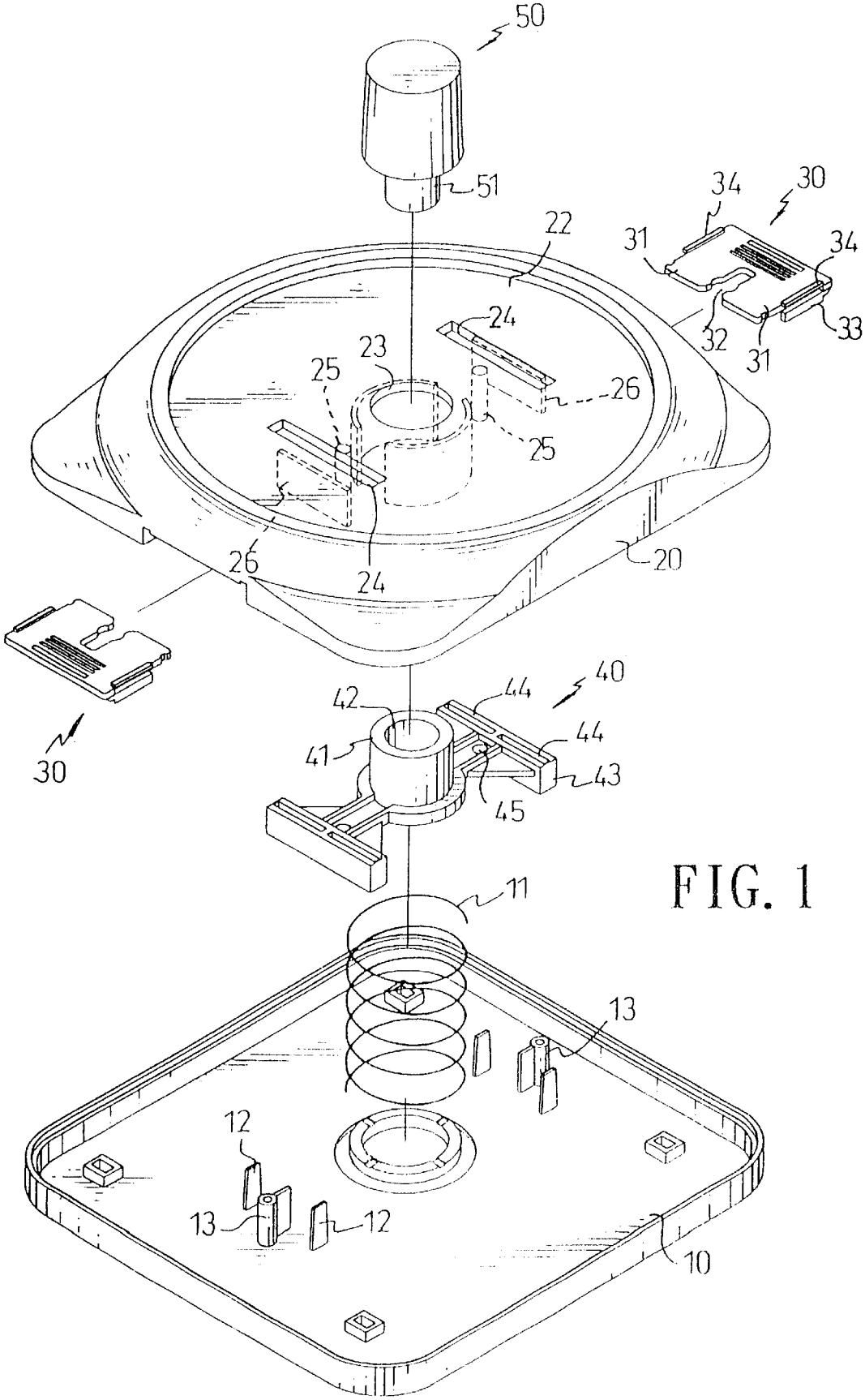
FIG. 1 is an exploded perspective view of a multi-functional sticking device for a label on a compact disk according to the present invention.
Figure 2:
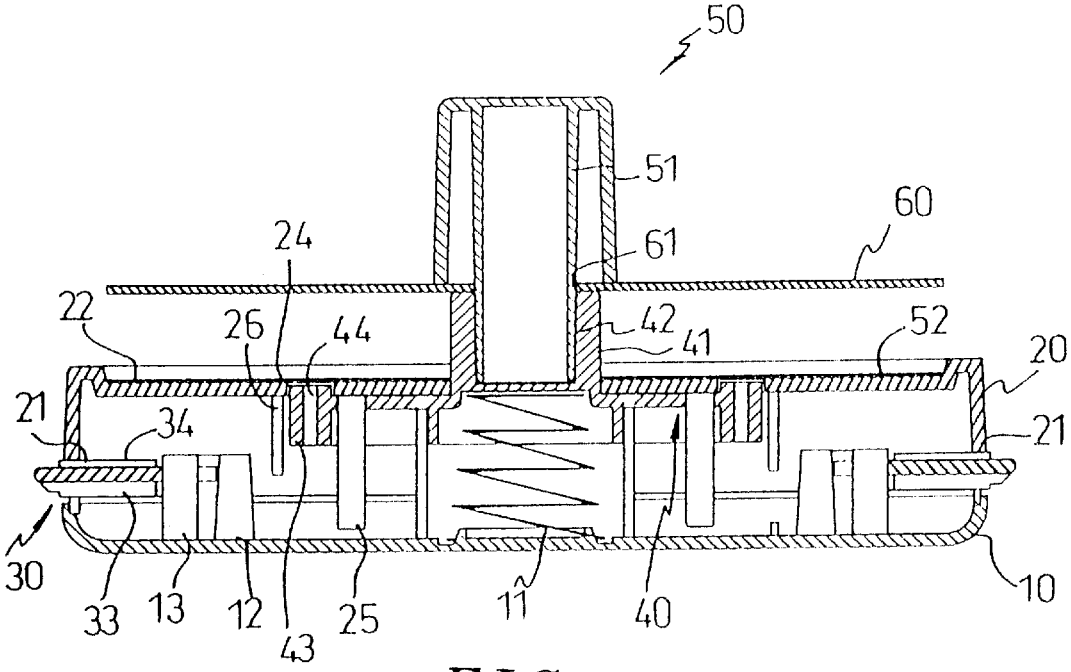
FIG. 2 is a sectional view of the sticking device shown in FIG. 1 after assembling illustrating the label being in a state of having not been stuck on a circular compact disk yet.

Referring to FIGS. 1, and 2, a multi-functional sticker device for a compact disk according to the present invention comprises a base 10, and a lid 20. The lid 20 is joined to the base 10 and a spring 11 with a proper elastic force is disposed between the lid 20 and the base 10.

The base 10 at two opposite sides thereof is provided with several stop pieces 12 and a post 13 respectively. The post 13 is disposed at a place near the outer side of a middle one of these stop pieces 12 at either side of the base 10.

The lid 20 at two lateral edges thereof is provided with an inserted recess 21 respectively for locating a guide plate 30. The lid 20 at the top thereof is formed as a receded fixing disk 22 with a circular central hole 23. Two opposite elongated slots 24 are provided on the fixing disk 22 with respect to the central hole 23. A reinforced post 25 with a reinforced plate 26 is disposed at a lateral side of the respective elongated slot 24 at the bottom of the fixing disk 22.

A movable seat 40 is disposed at the upper end of the spring 11 between the lid 20 and the base 10 and has a central cylinder 41 with a central groove 42. Two opposite engaging frames 43 are extended outward from the central cylinder 41 and several inserted slits 44 are provided on the respective engaging frame 43. A hole 45 is provided on the respective engaging frame 43 to be passed through by the respective reinforced post 25 such that the respective reinforced post 25 can be located in place.

Each guide plate 30 has a locating groove 32 and the locating groove 32 splits the guide plate 30 into two plate sections 31. Two opposite lateral edges of the respective guide plate 30 have a thick support piece 33 and a thin support piece 34 respectively.

A press knob 50 is provided with an inner stem 51 extending downward to fit with the central groove 42 in the central cylinder 41.

Figure 3:
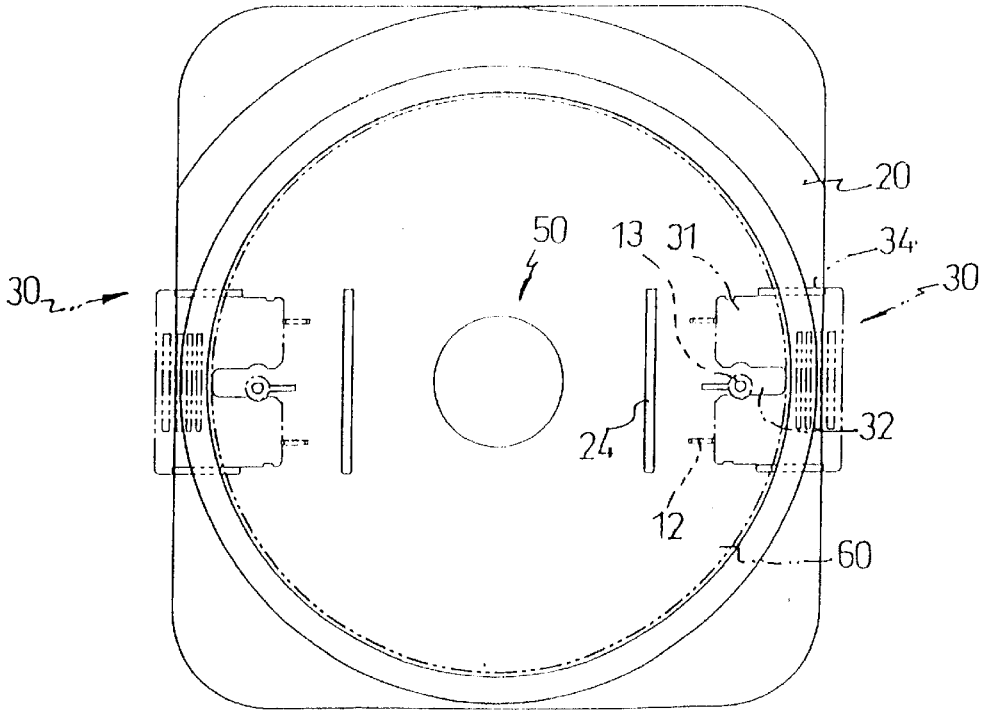
FIG. 3 is a top view of FIG. 2.
Figure 7:
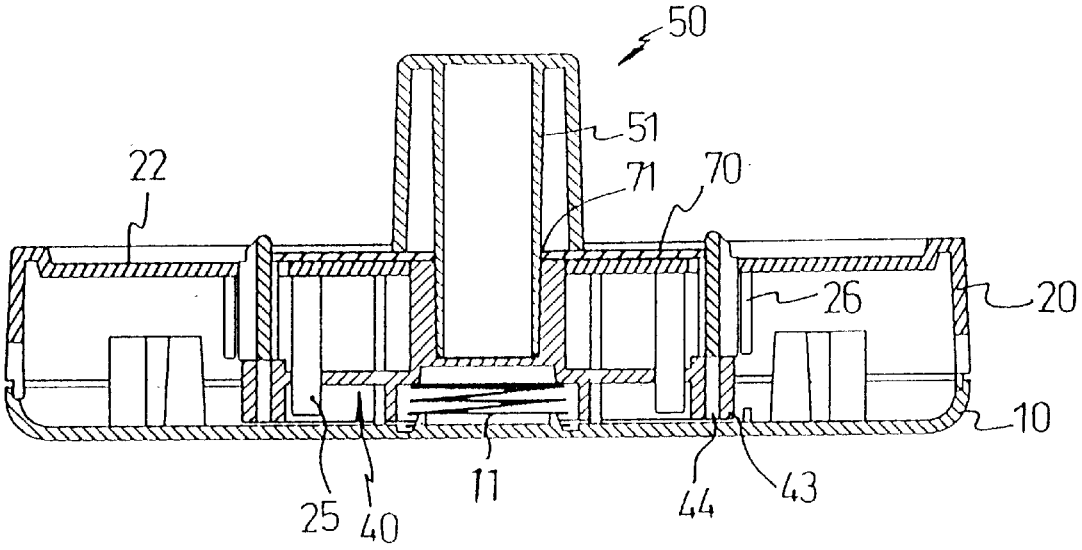
FIG. 7 is a sectional view of the sticking device similar to FIG. 5 illustrating the label being in a state of having been stuck on a name card shaped compact disk.

Referring to FIG. 3 and accompanying with FIG. 2 again, each guide plate 30 is inserted horizontally in each inserted recess 21 first before a sticker is attached to a circular compact disk. Then, the respective post 13 can be located at the locating groove 32 on the respective guide plate 30. Stop plates 12 on the base 1 are used for locating the respective plate section 31. The sticker 52 with glue on the back thereof is laid on the fixing disk 22 first, then the circular compact disk 60 is held by the cylinder 41. Finally, the inner stem 51 is inserted in the central groove of the cylinder 41 through the central hole 61 of the circular compact disk 60.

Figure 4:
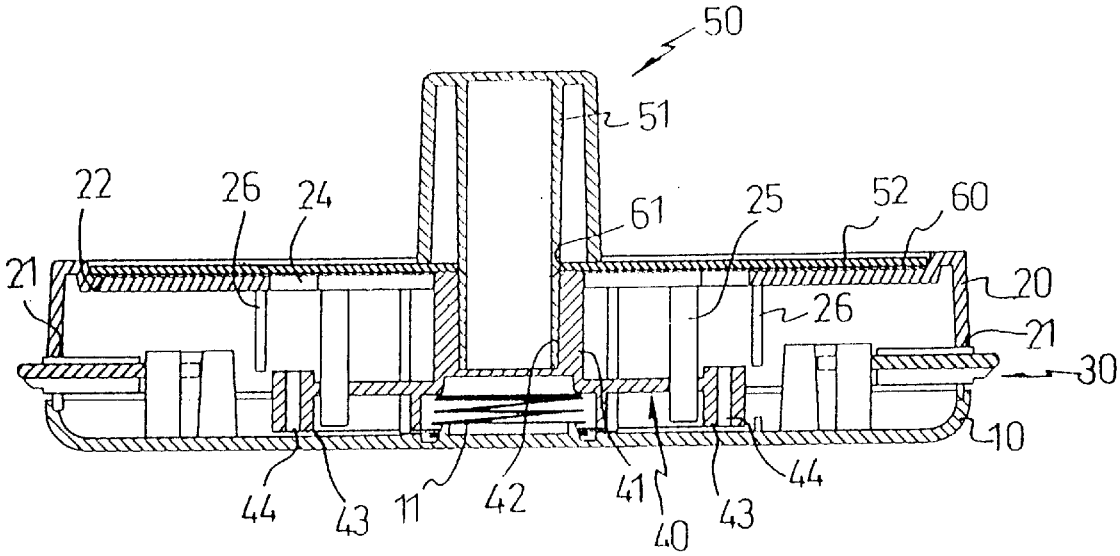
FIG. 4 is a sectional view of the sticking device similar to FIG. 2 illustrating the label being in a state of having been stuck on a circular compact disk.

Referring to FIG. 4, the circular compact disk 60 is facially moved downward with the central cylinder 41 while the press knob 50 is pressed downward such that the sticker 52 can be attached to the circular compact disk 60. Once the sticker 52 has been stuck on the circular compact disk, the press force is released from the press knob 50 and the circular compact disk 60 with the central cylinder 41 may move upward by way of the elastic force of the spring 11. Finally, the press knob 50 is taken out from the central groove 42 such that the circular compact disk 60 can be moved away from the central cylinder 41 to complete the operation of the sticker device.

Figure 6:
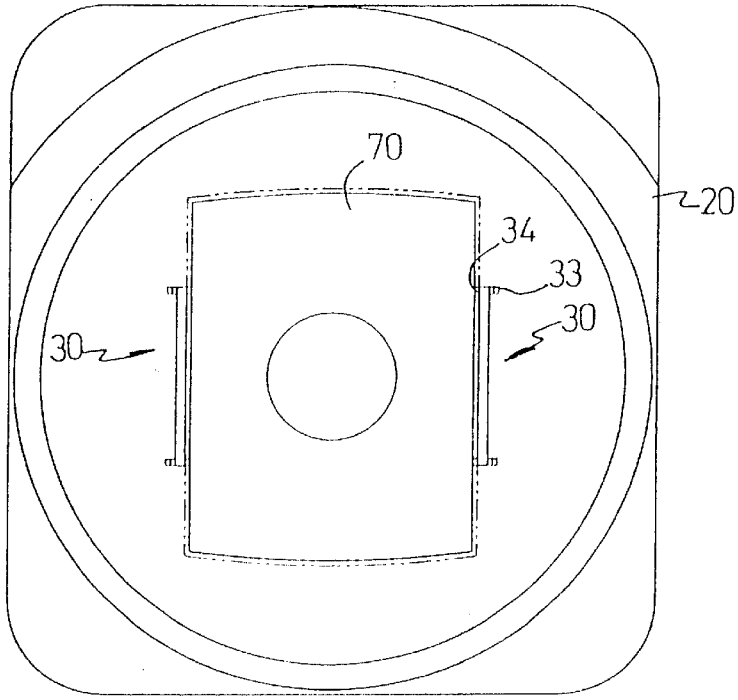
FIG. 6 is a top view of FIG. 5.
Figure 5:
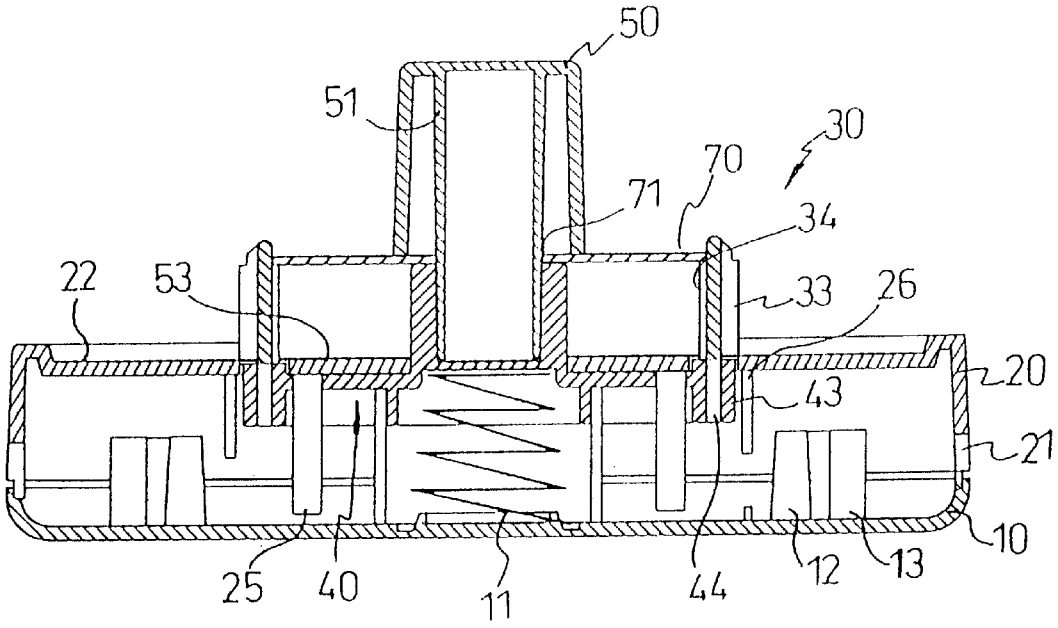
FIG. 5 is a sectional view of the sticking device shown in FIG. 1 after assembling illustrating the label being in a state of having not been stuck on a name card shaped compact disk yet.

Referring to FIGS. 5 and 6, a name card shaped compact disk 70 provided with a central hole 71 is illustrated. When the compact disk 70 is going to be stuck a sticker, both guide plates 30 have to be detached from both inserted recesses 21 respectively and then inserted into the respective slit 44. Each guide plate 30 is strengthened by way of the reinforced post 25 and the reinforced plate 26. The thick support piece 33 and the thin support piece 34 are used for supporting name card shaped compact disks 70 in different widths. The sticker 53 with the back thereof coated with glue is laid on the fixing disk 22 and the name card shaped compact disk 70 is supported by the respective thin support piece 34. Once the press knob 50 is pressed downward, each guide plate 30 may be pushed to move downward so as to stick the sticker 53 on the name card shaped compact disk 70. Accordingly, it is noted that the sticking device of the present invention is adaptable for both of the circular compact disk and the name card shaped compact disk.

It is appreciated that the present invention at least offers an advantage that different sized stickers 52, 53 can be stuck on a circular compact disk or a name card shaped compact disk. Therefore, the present invention is a simple sticker device provided with a wider adaptability.

While the invention has been described with reference to preferred embodiments thereof, it is to be understood that modifications or variations may be easily made without departing from the spirit of this invention, which is defined by the appended claims.

What is claimed is:

1. A multi-functional sticker device for a compact disk, comprising a base;

a lid with two opposite edges and a top, an inserted recess being formed at each of said two opposite edges, said top being formed as a receded fixing disk with a circular central hole, two opposite elongated through slots being provided on the fixing disk with respect to the central hole;

a spring with two ends, being disposed between the base and the lid, an end thereof being located at a central area of the base;

a movable seat, being disposed at the other end of the spring, having a central cylinder with a central groove, two opposite engaging frames being extended outward from the central cylinder, a plurality of inserted slits being provided on the respective engaging frame to corresponding to the respective elongated slot;

two guide plates, each of said two guide plates having a locating groove, said locating groove splitting the guide plate into two plate sections, two opposite lateral edges of the respective guide plate having a plurality of support pieces; and a press knob, being provided with an inner stem, extending downward to fit with the central groove in the central cylinder.

2. The multi-functional sticker device for a compact disk according to claim 1, wherein the base at two opposite sides thereof is provided with a plurality of stop pieces and a post respectively extending upward in a way of the post being disposed at a place near the outer side of said stop pieces at the same side.

3. The multi-functional sticker device for a compact disk according to claim 1, wherein a reinforced post with a reinforced plate is disposed at a lateral side of the respective elongated slot at the bottom of the fixing disk and a hole is provided on the respective engaging frame to be passed through by the respective reinforced post so as to be located in place.

4. The multi-functional sticker device for a compact disk according to claim 1, wherein said support pieces may be thick support pieces.

5. The multi-functional sticker device for a compact disk according to claim 1, wherein said support pieces may be thin support pieces.

* * * * *